US005136270A

United States Patent [19]

Hatanaka et al.

[11] Patent Number: 5,136,270

[45] Date of Patent: Aug. 4, 1992

[54] DIELECTRIC RESONATOR DEVICE

[75] Inventors: Hiroshi Hatanaka, Fujimi; Kanji Ohya; Masahiro Nishiki, both of Nagoya, all of Japan

[73] Assignees: Nihon Dengyo Kosaku Co., Ltd., Tokyo; NGK Spark Plug Co., Ltd., Nagoya, both of Japan

[21] Appl. No.: 523,890

[22] Filed: May 16, 1990

[30] Foreign Application Priority Data

May 22, 1989 [JP] Japan ..... 1-59573[U]

[51] Int. Cl.[5] ..... H01P 7/10

[52] U.S. Cl. ..... 333/219.1; 333/234

[58] Field of Search ..... 333/202, 219, 219.1, 333/235, 234, 222, 226, 227, 229-232; 331/68, 96, 107 DP

[56] References Cited

U.S. PATENT DOCUMENTS

| | | | |
|---|---|---|---|
| 4,028,652 | 6/1977 | Wakino et al. | 333/235 X |
| 4,143,344 | 3/1979 | Nishikawa et al. | 333/219.1 X |
| 4,268,809 | 5/1981 | Makimoto et al. | 333/224 X |
| 4,620,168 | 10/1986 | Delestre et al. | 333/219.1 X |
| 4,630,012 | 12/1986 | Fuller et al. | 333/235 |
| 4,639,699 | 1/1987 | Nishikawa et al. | 333/219.1 X |
| 4,757,289 | 7/1988 | Kosugi et al. | 333/235 X |

FOREIGN PATENT DOCUMENTS

| | | | |
|---|---|---|---|
| 0074217 | 6/1980 | Japan | 333/234 |
| 0021101 | 2/1982 | Japan | 333/234 |
| 0097201 | 6/1984 | Japan | 333/234 |
| 0258505 | 11/1986 | Japan | 333/219.1 |
| 0072204 | 4/1987 | Japan | 333/219.1 |
| 0097405 | 5/1987 | Japan | 333/234 |
| 0266902 | 11/1988 | Japan | 333/219.1 |

*Primary Examiner*—Eugene R. Laroche
*Assistant Examiner*—Seung Ham
*Attorney, Agent, or Firm*—Larson & Taylor

[57] ABSTRACT

A dielectric resonator device comprising a resonator body having a dielectric resonator element of dielectric ceramics, and a supporting member integrally formed with the resonator element and made of the same material as that of the resonator element, the resonator element being provided with an inner hole, if necessary.

6 Claims, 2 Drawing Sheets

DIELECTRIC RESONATOR DEVICE

BACKGROUND OF THE INVENTION

The present invention relates to a dielectric resonator device which may be used as a filter or an oscillator in microfrequency regions.

There is a known dielectric resonator device in which a dielectric resonator element is mounted on an inner base wall of a shield casing via a supporting member. An example of such a dielectric resonator device is illustrated in FIG. 1. As will be seen in FIG. 1, it comprises a dielectric resonator element A of a circular or rectangular shape in cross section, a metal casing B for containing the resonator element A and an insulating holder member C made of alumina or forsterite. The resonator element A is mounted on the base portion of the metal casing B by the insulating holder member C so that the resonator element A has a desired Q-characteristic. The resonator element A is connected with the insulating holder member C by means of a heat-resisting adhesive layer D of an adhesive containing a glass glaze as a main component, silica containing adhesive or the other adhesive.

When the resonator device is operated, the resonator element A is self-heated with the resonance thereof. In particular, when the resonator is actuated with higher power, the higher the operation frequency is the larger the heat release value in the resonator element.

The heat-resisting adhesive layer D has a poor heat transfer efficiency because it contains air bubbles. Therefore, the heat-resisting adhesive layer D makes it difficult to transfer the heat in the resonator element to the insulating holder member C.

There may occur a heat-accumulation in the resonator element A so that it has a higher temperature. As a result, there may occur a pull-up between the resonator element A and the insulating holder member C or between the metal casing B and the insulating holder member C, and the resonance characteristic of the device may be varied.

Further, since the insulating holder member C is provided for mounting the resonator element A on the base portion of the metal casing B, the number of parts is increased and it is necessary to connect the resonator element A with the insulating holder member C, which results in expensive device.

SUMMARY OF THE INVENTION

It is therefore an object of the present invention to provide a dielectric resonator device capable of overcoming said disadvantages in the prior art, being simply assembled and having an excellent heat dissipation.

According to the present invention, there is provided a dielectric resonator device comprising a dielectric resonator body of dielectric ceramics having a resonator portion and a supporting portion, and a base member for mounting the dielectric resonator body, wherein the resonator portion and supporting portion of the dielectric resonator body are integrally formed, and the resonator portion of the resonator body is fixed on the base member by the supporting portion.

The resonator body may be provided with an inner hole at least through the resonator portion.

The inner hole may be intended for expediting a heat dissipation or additionally for tuning the resonant frequency by inserting a tuning member of dielecreic material thereinto.

The resonator portion and supporting portion of the dielectric resonator body may be provided with a through hole extending along the center axis thereof.

Alternatively, the resonator portion and supporting portion of the dielectric resonator body may be provided with a bottomed hole extending along the center axis thereof. In this case, the resonator body may be fixed on the base member by clamping a screw through the bottom of the hole.

The resonator portion and supporting portion of the dielectric resonator body may be of circular or rectangular cross section.

Furthermore, the mounting member may be a portion of a casing for containing the resonator body.

Since the resonator portion and supporting portion of the dielectric resonator body are integrally formed and thus there is no adhesive layer therebetween, even if the resonator portion generates a heat as the result of a resonance, the generated heat may be quickly transferred to supporting portion. By provision of the inner bore on the resonator portion, the heat transfer or dissipation may be more effectively expedited.

The present invention will now be described by way of example with reference to the accompanying drawings:

DETAILED DESCRIPTION

Figure 1:
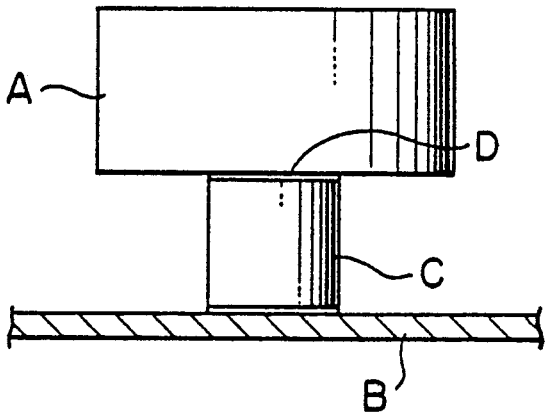
FIG. 1 PRIOR ART
FIG. 1 is a side view schematically showing a conventional dielectric resonator device, parts being broken away.
Figure 2:
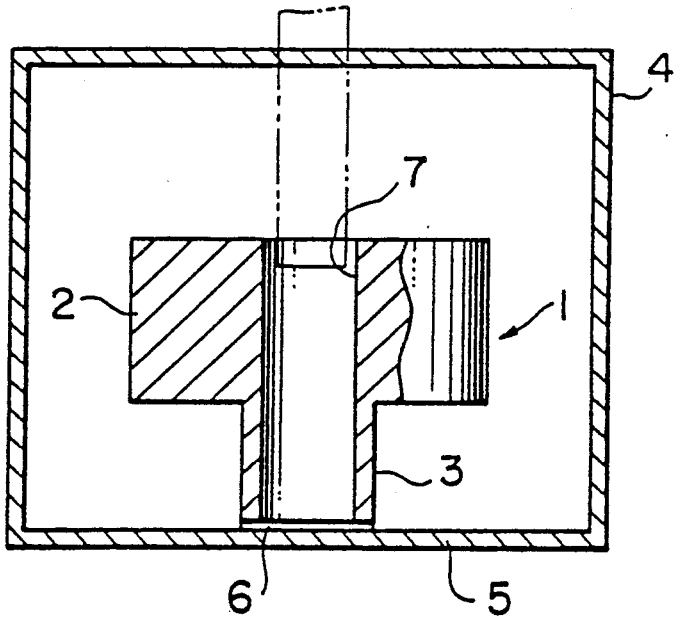
FIG. 2 is a partially cutaway side view schematically showing a dielectric resonator device according to one embodiment of the present invention.

Referring to FIG. 2, there is shown a dielectric resonator device according to an embodiment of the present invention.

The reference numeral 1 represents a dielectric resonator body which may be of dielectric ceramic material such as $TiO_2$, $BaO\text{-}TiO_2$. This dielectric resonator body 1 comprises a resonator portion 2 having a circular cross section of a larger diameter and a supporting portion 3 having a circular cross section of a smaller diameter which are integrally formed by means of press molding or other suitable method. The reference numeral 4 represents a metal casing on the bottom wall 5 of which the dielectric resonator body 1 is fixed by an adhesive layer 6. The reference numeral 7 represents a through hole which is provided along the center axis of the resonator portion 2 and the supporting portion 3 of the dielectric resonator body 1. The through hole 7 is intended to increase the contact area between the resonator body 1 and the atmosphere thereby expediting a heat dissipation. When the resonator body 1 is activated, the heat generated in the resonator portion 2 can be quickly transferred to the supporting portion 3 and can be expedited so that the resonator portion 2 can be prevented from raising in the temperature.

Figure 3:
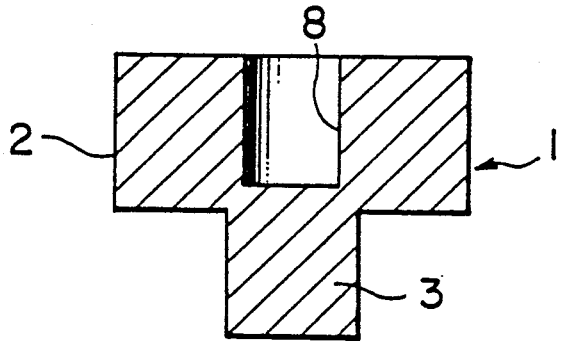
FIGS. 3 to 5 are longitudinal sections showing various dielectric resonator bodies in different embodiments of the present invention, respectively.

FIG. 3 shows another embodiment of the present invention in which the components are the same as those in the first embodiment of FIG. 2 excepting the construction of a hole to be provided in the resonator body. Thus, the reference numerals are used to designate the components corresponding to those in the first embodiment.

With the embodiment shown in FIG. 3, a bottomed hole 8 is provided along the center axis of the resonator portion or element 2 of the resonator body 1.

Figure 4:
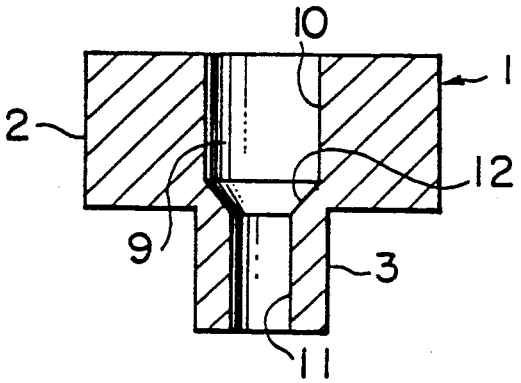

FIG. 4 shows a further embodiment of the present invention in which there is provided a through hole 9 along the center axis of the resonator body 1. In this case, the through hole 9 comprises a hole portion 10 having a larger diameter in the resonator element 2 and a hole portion 11 having a smaller diameter in the supporting portion 3, and the hole portions 10 and 11 are communicated to each other via a shoulder or frustum portion 12.

With the illustrated embodiments, although the resonator element 2 and the supporting portion 3 of the dielectric resonator body 1 are of a circular cross section, it is appreciated that the resonator element 2 and the supporting portion 3 may be formed to have a rectangular cross section or a polygonal cross section.

Figure 5:
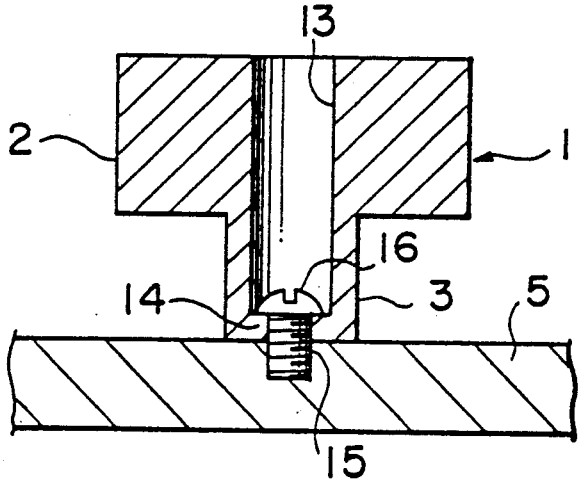

Further, the embodiment illustrated in FIG. 3 may be modified as shown in FIG. 5 in which a bottomed hole 13 is provided along the center axis of the resonator body 1. The bottomed hole 13 has a bottom portion 14 through which a threaded hole 15 is formed. In this case, the resonator body 1 is mounted on the bottom wall 5 of the metal casing 4 by screwing a screw 16 through the threaded hole 15 of the bottom portion 14 into the bottom wall 5 of the metal casing 4.

Additionally, the hole provided in the dielectric resonator body of each embodiment may be used to tune the resonant frequency to an intended level. That is, the tuning of the resonant frequency may be performed by inserting loosely a tuning rod of dielectric material into the hole and adjusting the position or level of the inserted tuning rod in the hole (as illustrated by a dot-dash line in FIG. 2).

Finally, the dielectric resonator body in the illustrated embodiments may be applied to a stripline arrangement. In this case, a dielectric substrate may be used as the base member, on the upper surface of which the resonator arrangement may be mounted.

As illustrated and described above, according to the present invention since the resonator element and its supporting member are integrally constructed by using suitable dielectric materials, any provision of an adhesive layer between the resonator element and the supporting member can be avoided and a heat dissipation in the resonator body can be substantially improved, thereby preventing the resonator element from getting a high temperature and overcoming any problem of peeling off of the adhesive layer. Also, by provision of the inner hole along the center axis of the resonator body it can be avoided that the heat generated in the resonator element is working inside, and thus the heat dissipation can be more effectively expedited, thereby securing a stabilized resonance characteristic of the resonator device.

In case the inner hole is to be used to tune the resonant frequency to the intended level, the dielectric resonator device can be easily and precisely tuned to a desired resonant frequency by adjusting the position or level of the insertion of the tuning member of the dielectric material into the hole.

Furthermore, the present invention has an advantage that it is possible to reduce the number of parts necessary for assembling the resonator device and to simplify the manufacture in the point of jointing procedure. This results in a cheaper device.

It is to be understood that the present invention in not restricted to the particular embodiments illustrated and that numerous modifications and alternations may be made by those skilled in the art without departing from the spirit and scope of the invention.

What is claimed is:

1. A dielectric resonator device comprising a dicrete dielectric resonator body consisting of a discrete resonator portion and a discrete supporting portion with both said resonator portion and said supporting portion being made of a same dielectric material and being in direct heat conducting contact with one another across facing portions thereof, and a base member for mounting the discrete dielectric resonator body, wherein the resonator portion and supporting portion of said dielectric resonator body are integrally formed by pressing as a unitary one-piece structure, and the resonator portion of said resonator body is fixed on the base member by the supporting portion.

2. A dielectric resonator device as claimed in claim 1, wherein said base member is a portion of a metal casing for containing the resonator body.

3. A dielectric resonator device comprising a discrete dielectric resonator body consisting of a discrete resonator portion and a discrete supporting portion with both said resonator portion and said supporting portion being made of a same dielectric material and being in direct heat conducting contact with one another across facing portions thereof, and a base member for mounting the discrete dielectric resonator body, wherein the resonator portion and supporting portion of said dielectric resonator body are integrally formed by pressing as a unitary one-piece body, the resonator portion of said resonator body is fixed on the base member by the supporting portion, and said resonator body is provided with an inner hole at least through the resonator portion.

4. A dielectric resonator device as claimed in claim 3, wherein said inner hole in the resonator body is extended to the end portion of the supporting portion.

5. A dielectric resonator device as claimed in claim 3, wherein said inner hole in the resonator body is a bottomed hole through which a clamping screw is screwed for mounting the resonator body on the base member.

6. A dielectric resonator device as claimed in claim 3, wherein said base member is a portion of a metal casing for containing the resonator body.

* * * * *